US008826897B2

(12) United States Patent
Zhou

(10) Patent No.: US 8,826,897 B2
(45) Date of Patent: Sep. 9, 2014

(54) METHOD CAPABLE OF ENHANCING HEAT EXCHANGING AND HUMIDIFYING PERFORMANCE OF WARMING STOVE AND WARMING STOVE WITH HUMIDIFYING FUNCTION

(76) Inventor: Zhizhuang Zhou, Zhejiang (CN)

( * ) Notice: Subject to any disclaimer, the term of this patent is extended or adjusted under 35 U.S.C. 154(b) by 191 days.

(21) Appl. No.: 13/450,394

(22) Filed: Apr. 18, 2012

(65) Prior Publication Data

US 2013/0081699 A1 Apr. 4, 2013

(30) Foreign Application Priority Data

Sep. 30, 2011 (CN) ..... 2011 1 0310302

(51) Int. Cl.
*F24C 13/00* (2006.01)
*F24C 15/00* (2006.01)

(52) U.S. Cl.
CPC ..... *F24C 15/003* (2013.01)
USPC ..... 126/5; 126/6; 126/113; 126/508; 237/78 R

(58) Field of Classification Search
CPC ..... F24F 1/00; F24F 3/14; F24F 6/00; F24F 6/14; F24C 15/003; F24C 5/00; F24D 5/00
USPC ..... 126/5, 113, 508; 237/78 R
See application file for complete search history.

(56) References Cited

U.S. PATENT DOCUMENTS

| | | | | | |
|---|---|---|---|---|---|
| 1,380,321 | A | * | 5/1921 | Liebold | 126/113 |
| 1,443,490 | A | * | 1/1923 | McHenry | 126/113 |
| 1,591,136 | A | * | 7/1926 | Loudermiltt | 126/70 |
| 1,877,223 | A | * | 9/1932 | Buck | 261/1 |
| 2,190,410 | A | * | 2/1940 | Mallory | 126/108 |
| 2,705,488 | A | * | 4/1955 | Wright | 126/508 |
| 2,810,381 | A | * | 10/1957 | Knight | 126/113 |
| 3,918,640 | A | * | 11/1975 | Piccino et al. | 239/4 |
| 4,135,370 | A | * | 1/1979 | Hosoda et al. | 62/274 |
| 4,178,908 | A | * | 12/1979 | Trexler, Sr. | 126/502 |
| 4,186,718 | A | * | 2/1980 | Goodwin | 126/67 |
| 4,241,719 | A | * | 12/1980 | Vickery | 126/66 |
| 4,381,759 | A | * | 5/1983 | Faustini | 126/502 |
| 4,612,777 | A | * | 9/1986 | Noma et al. | 62/247 |
| 5,479,915 | A | * | 1/1996 | Riener | 126/512 |
| 5,702,648 | A | * | 12/1997 | White et al. | 261/142 |
| 5,873,356 | A | * | 2/1999 | Vossler et al. | 126/110 E |

* cited by examiner

*Primary Examiner* — Kenneth Rinehart
*Assistant Examiner* — Jorge Pereiro

(57) ABSTRACT

A method capable of enhancing the heat exchanging and humidifying performance of a warming stove and a warming stove with a humidifying function. Water fog is guided into the initial end of an air channel of a stove body, so that the water fog flows through a heat exchange region in the air channel along with circulating air; and the water fog is gasified under a high temperature, so that the circulating air is changed into wet air in the process and carried into a warming space from an outlet at the tail end of the air channel. Heat exchange function is greatly enhanced, and more heat energy can be taken away by humidity-containing gas in each unit volume.

12 Claims, 6 Drawing Sheets

METHOD CAPABLE OF ENHANCING HEAT EXCHANGING AND HUMIDIFYING PERFORMANCE OF WARMING STOVE AND WARMING STOVE WITH HUMIDIFYING FUNCTION

CROSS REFERENCE TO RELATED PATENT APPLICATION

The present application claims the priority of Chinese patent application No. 201110310302.5 filed on Sep. 30, 2011, which application is incorporated herein by reference.

FIELD OF THE INVENTION

The invention relates to the technical field of a warming stove, in particular to a method capable of enhancing the heat exchanging and humidifying performance of a warming stove and a warming stove with humidifying function.

BACKGROUND OF THE INVENTION

A solid wood particle warming stove, the other conventional fireplaces and the like, which are popularized on the present international and domestic markets, can lead air in the space to be overdried and lead people to feel hot, dry and uncomfortable once being used for heating and warming for a long time. An ultrasonic humidifier (atomizer) which is popularized on the market for humidifying indoor air is imperfect in a humidifying effect since the temperature of water fed into a water box always lags behind the rise of the room temperature and only can be close to the room temperature after a long time because a function for warming a water source is unviable, and a few water can be accumulated around the humidifier in the morning caused by downward low-temperature fog and upward hot air if a device for enhancing air convection is not existed in the space when the temperature of the fog is lower than that of indoor environment because the atomization is a physical cooling process.

Therefore, by improving the existing warming stove, the present invention provides a warming stove with a humidifying function, wherein a water fog generator is disposed behind a stove body, a box body of the water fog generator is made from a heat conducting material, water temperature in the box body can reach 60-70 DEG C. since the box body is heated by heat energy in the stove body, and a phenomenon of condensation can be effectively avoided since the fog sprayed out of a fog spray pipe is mixed with hot air exhausted out of an exhaust pipe, so that the fog and the hot air can be mixed together and carried to all corners in a room along with a warm air system of the warming stove.

Aiming at the patent, a sample is manufactured by an applicant. The practice proves that although the technical solution can overcome the happening of the condensation phenomenon to some degrees, the fog is still existed in the air in the form of fine particles, the fog is mixed with the hot air at an hot air outlet and is further carried into a warming space, the temperature of the fog is close to that of the air at the hot air outlet, the fog is also existed in the form of water fog particles rather than steam when being fed into the warming room, and the white water fog can be macroscopically seen in the air, so that the humidifying effect still needs to be improved.

SUMMARY OF THE INVENTION

Aiming at the defects in the prior art, the present invention provides a method capable of enhancing the heat exchanging and humidifying performance of a warming stove and a warming stove with a humidifying function manufactured using same. Water fog is guided into the initial end of an air channel of a stove body, so that the water fog flows through a heat exchange region in the air channel, is gasified in a heating way to be changed into the steam when passing through the heat exchange region, is carried into a warming space from an outlet at the tail end of the air channel, and is existed in the warming region in the form of steam rather than fog, so that people feels comfortable, each place in the space is even in humidity, and the humidifying effect is greatly improved.

The technical solution of the present invention is implemented as follows:

A method capable of enhancing the heat exchanging and humidifying performance of a warming stove comprises the following steps of: leading water fog into an initial end at an air channel of a stove body, so that the water fog flows through a heat exchange region in the air channel along with circulating air; and gasifying the water fog at a high temperature, so that the circulating air is changed to be wet air in the process and carried to the warming space from the outlet at the tail end of the air channel.

A warming stove with a humidifying function comprises a water fog generator and a stove body, wherein the stove body is internally provided with a stove cavity, a heat exchanger is disposed on the wall of the stove cavity, an air-resistant clapboard is disposed behind the stove cavity, an air channel is formed between the air-resistant clapboard and the stove cavity, a region between the air-resistant clapboard and the heat exchanger is a heat exchange region, the initial end of the air channel is connected with a fan, the tail end of the air channel is an air supply outlet, an opening is disposed on the air-resistant clapboard adjacent to the initial end of the air channel, and a spray jet of the water fog generator is communicated with the opening.

Preferably, the lower end of the opening is bent towards the direction of the stove cavity to form into a guide plate, and the spray jet of the water fog generator is faced to the opening. The water fog is guided into the air channel from the opening and a negative pressure region is formed thereat due to the setting of the guide plate, so that the water fog can be automatically pumped into the air channel, and the water fog generator does not need to be additionally provided with a fog transporting fan, therefore, the cost is reduced.

In order to avoid the air leakage, preferably, the guide plate is a plane plate, and the left end and the right end of the guide plate are connected with the air-resistant clapboard by a triangular plate.

Preferably, the opening is externally provided with an air guide sleeve, and the spray jet of the water fog generator is disposed in the opening at the lower end of the air guide sleeve. The water fog can not be outwards dispersed and can be wholly fed into the air channel from the opening and the guide plate due to the setting of the air guide sleeve.

Preferably, the water fog generator comprises a water box and a water fog generating cavity, which are disposed with each other in a splitting way, wherein the water fog generating cavity is internally provided with an ultrasonic wave energy converter, the water box is connected with the water fog generating cavity by a water pipe, and the water fog generating cavity is disposed at the opening of the air-resistant clapboard. The water fog generator is set in a splitting way, so that the water box is convenient to feed water.

A connecting water pipe between the water box and the water fog generating cavity has a certain water storage capacity due to a distance generated by the different positions of the water box and the water fog generating cavity, wherein the saturation capacity of the cubage, i.e. the water level ultrahigh quantity or the spillage of the ultrasonic wave energy converter in the water fog generating cavity when the water box needs to be fed with water, can cause an accident. Therefore, a connecting place between the water pipe and the water box is provided with a two-way valve for simultaneously sealing the water box and the water pipe when the water box is separated from the water pipe or communicating the water box with the water pipe when the water box is connected with the water pipe. The two-way valve is split and closed respectively when the water box departs from the water pipe to feed the water, so that the water can not be leaked out of the water box, and the saturated water quantity in the water pipe can not be overflowed to the direction of the ultrasonic wave energy converter, thus the accident can be avoided. After the water box is fed with the water to be combined with the water pipe in place, the valve not only can lead the water box to feed the water to the water fog generating cavity through the water pipe but also can lead the air to be ref lowed and fed to the space of the water box by the water pipe and the valve.

Preferably, the two-way valve comprises an upper valve body disposed on the water box and a lower valve body disposed on the water pipe, wherein the upper valve body comprises a sleeve for jacking and getting through the lower valve, the upper end of the sleeve is communicated with the water box, the sleeve is internally provided with an ejector rod and an ejector rod positioning ring, the ejector rod positioning ring is fixedly connected with the inner wall of the sleeve, the ejector rod is movably sleeved in the ejector rod positioning ring, the upper end of the ejector rod is provided with a first seal ring for sealing an opening at the upper end of the sleeve, the lower end of the ejector rod is provided with an ejector block, a first spring is sleeved on the ejector rod between the ejector block and the ejector rod positioning ring, and two ends of the first spring respectively lean against the ejector block and the ejector rod positioning ring; the lower valve body comprises a colliding block matched with the ejector block, the colliding block is fixed on a colliding block positioning ring, the colliding block positioning ring is connected with the lower valve body, the lower end of the colliding block is connected with a valve rod, a second seal ring for sealing an opening of the lower valve is movably sleeved on the valve rod, a second spring is sleeved on the valve rod, the upper end of the second spring leans against the second seal ring, and the lower end of the second spring leans against a spring seat at the lower end of the valve rod; and the lower end of the sleeve of the upper valve body penetrates through the colliding block positioning ring to downwards press the second seal ring so as to get through the lower valve body, and the ejector rod upwards move to get through the upper valve body due to the functions of the ejector block of the upper valve body and the colliding block of the lower valve body when the upper valve body and the lower valve body are combined with each other.

Preferably, the two-way valve comprises an upper valve body disposed on the water box and a lower valve body disposed on the water pipe, wherein the upper valve body comprises an outer ring, the upper end of the outer ring is communicated with the water box, the outer ring is internally provided with an ejector rod and an ejector rod positioning ring, the ejector rod positioning ring is fixedly connected with the inner wall of the outer ring, the ejector rod is movably sleeved in the ejector rod positioning ring, the upper end of the ejector rod is provided with a first seal ring for sealing an opening at the upper end of the outer ring, the lower end of the ejector rod is provided with an ejector block, a first spring is sleeved on the ejector rod between the ejector block and the ejector rod positioning ring, and two ends of the first spring respectively lean against the ejector block and the ejector rod positioning ring; the lower valve body comprises a valve rod and a valve rod positioning ring, wherein the valve rod is movably sleeved in the valve rod positioning ring, the valve rod positioning ring is connected with the inner wall of the opening of the lower valve body, the upper end of the valve rod is provided with a colliding block matched with the ejector block, a second seal ring for sealing the opening of the lower valve body is fixedly sleeved on the valve rod under the valve rod positioning ring, a second spring is sleeved on the valve rod above the valve rod positioning ring, and two ends of the second spring respectively lean against the colliding block and the valve rod positioning ring; and the ejector block of the upper valve body is collided with the colliding block of the lower valve body, the ejector rod and the first seal ring of the upper valve body upwards move to get through the upper valve body, and the valve rod and the second seal ring of the lower valve body downwards move to get through the lower valve body when the upper valve body and the lower valve body are combined with each other.

Preferably, the water box is provided with a water box cover for feeding water, the upper valve body is fixed on the water box cover, a flange is slantwise and downwards disposed along with the periphery of the water box cover, the shape of the upper end of the lower valve body matches with that of the flange, and the flange is buckled on the lower valve body. The water box cover is in threaded connection with the water box, wherein the water box is withdrawn to be overturned at 180 degrees and the water box cover is unscrewed when the water is fed, and the water box is overturned at 180 degrees again to be buckled on the lower valve body after the water is fed.

In order to be convenient to position, preferably, the bottom of the ejector block is provided with a groove or a lug boss, and the top of the colliding block is correspondingly provided with a lug boss or a groove matched with the ejector block.

Preferably, the water box is made from a heat conducting material and is disposed at the place that is adjacent to the heat exchanger outside the air channel. The water in the water box is heated by the heat energy in the stove body, the temperature of the water is heated up to be 60-70 DEG C., and a plurality of water molecules are active at the time, so that the atomization can be accelerated.

Preferably, the water fog generator comprises a box body, wherein the box body is connected with an air inlet pipe and a fog spray pipe, one end of the air inlet pipe is disposed in the water fog generator, the other end of the air inlet pipe is communicated with the air channel, one end of the fog spray pipe is disposed in the water fog generator, and the other end of the fog spray pipe is communicated with the opening. Air of the fan is guided into the water fog generator by the air inlet pipe, and the water fog generated by the water fog generator is guided into the air channel through the fog spray pipe, is heated by the heat exchange region along with circulating air, and is carried into the warming space.

Preferably, the water box is made from a heat conducting material and is disposed at the place that is adjacent to the heat exchanger outside the air channel. The water box of the water fog generator is heated by the heat energy in the stove body, the temperature of the water is heated up to be 60-70 DEG C., and a plurality of water molecules are active at the time, so that the atomization can be accelerated.

Preferably, the other end of the fog spray pipe extends into the air channel from the opening, and the orientation of the opening of the fog spray pipe is as the same as the air direction. The fog spray pipe extends into the air channel, and the orientation of the opening of the fog spray pipe is as the same as the air direction, so that the water fog is good for being combined with the circulating air, and the circulating air can not be inversely blown into the fog spray pipe.

By adopting the technical solution, the design idea and the beneficial effects of the present invention are as follows:

The water fog is guided into the initial end of the air channel of the stove body, so that the water fog flows through the heat exchange region in the air channel along with the circulating air; and the water fog is gasified to be changed into the steam at a high temperature, so that the circulating air is changed to be wet air in the process and carried to the warming space from the outlet at the tail end of the air channel.

Specifically, water in the water box has been preheated at 60-70 DEG C. due to the stove temperature, the water molecules are active in moving, and the white water fog generated by the water fog generator is carried into the heat exchange region which is more than 300 DEG C. by the circulating wind when being carried into the initial end of the air channel, so that a plurality of fog particles exchange the heat with the heat exchanger to be further gasified, and the fog that is carried into the warming space is dispersed in the form of steam rather than fog, therefore, the humidifying effect is greatly improved; and the water fog is fed into the heat exchange region, so that a heat exchange function is greatly enhanced, and more heat energy can be taken away by humidity-containing gas in each unit volume compared with dry air under the same flow, so that the warming stove is higher in efficiency, and more obvious in an effect for adjusting the temperature and the humidity of the indoor air, therefore, the present invention is an update and upgrade engineering to achieve an effect which is approximate to be prefect, and the practice proves that the present invention is quicker in room temperature rise, is soft and even in indoor humidity, leads people to feel more comfortable in the door, and is very good in effect.

DETAILED DESCRIPTION OF PREFERRED EMBODIMENTS

Figure 1:
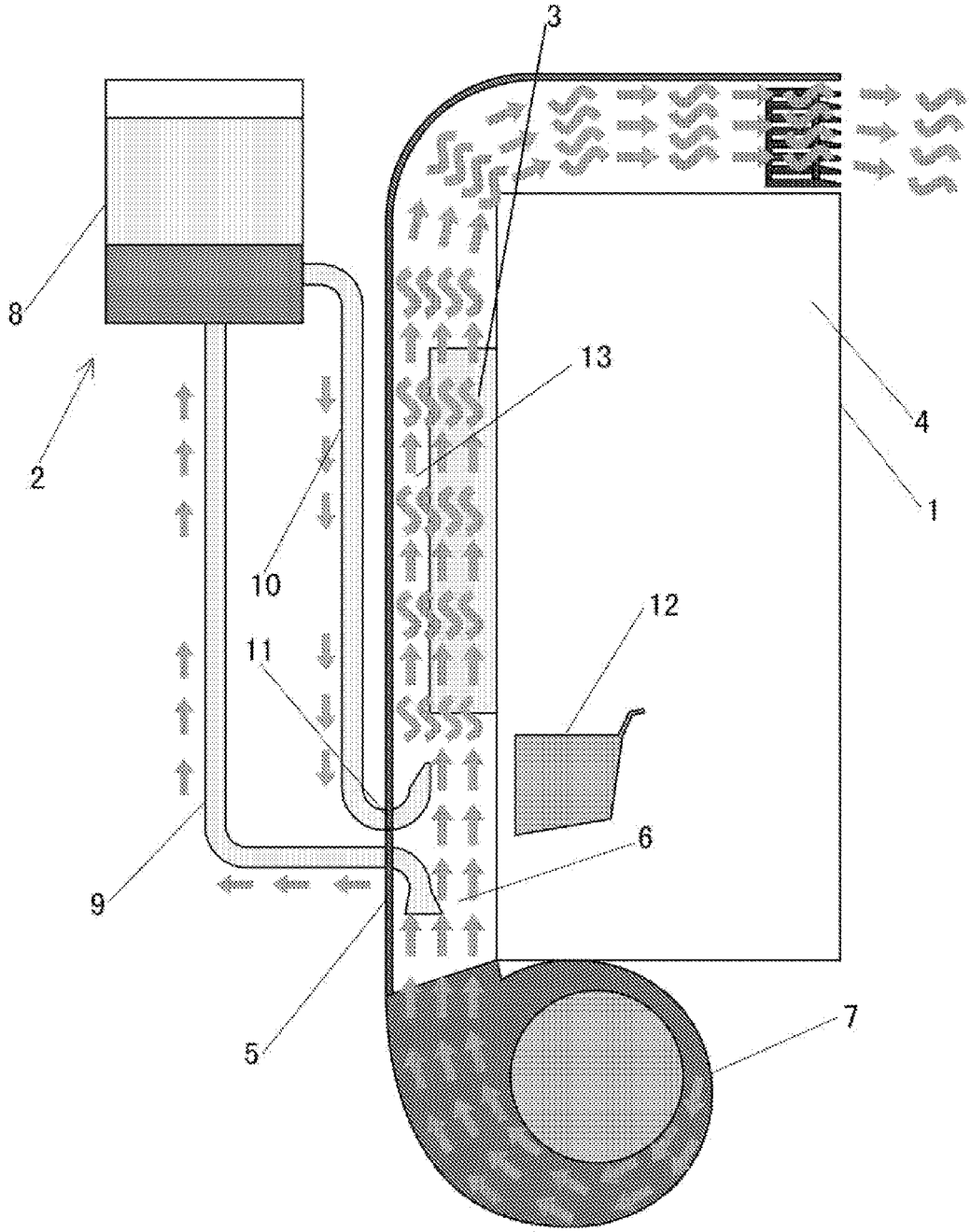
FIG. 1 is a structure diagram showing a warming stove with a humidifying function in an embodiment 1 of the present invention.

The embodiments of the present invention are described as follows:

Embodiment 1: A warming stove with a humidifying function of the embodiment shown in FIG. 1 comprises a water fog generator 2 and a stove body 1, wherein the stove body 1 is internally provided with a stove cavity 4, the stove cavity 4 is internally provided with a fuel hopper 12, a heat exchanger 3 is disposed on the wall of the stove cavity, an air-resistant clapboard 5 is vertically disposed behind the stove cavity 4, an air channel 6 is formed between the air-resistant clapboard 5 and the stove cavity 4, a region between the air-resistant clapboard 5 and the heat exchanger 3 is a heat exchange region 13, an initial end under the air channel is connected with a fan 7, and the tail end above the air channel is an air supply outlet.

The water fog generator 2 comprises a box body 8, wherein the box body 8 is made from a heat conducting material, and the box body 8 is disposed at the place that is adjacent to the heat exchanger 3 outside the air channel; and an opening 11 is disposed on the air-resistant clapboard 5 adjacent to the initial end of the air channel, and a spray jet of the water fog generator is communicated with the opening 11. The water fog generator 2 generates the water fog by adopting an ultrasonic humidifying principle.

Specifically, the box body 8 is connected with an air inlet pipe 9 and a fog spray pipe 10, one end of the air inlet pipe 9 is disposed in the water fog generator 2, the other end of the air inlet pipe 9 extends into the air channel 6, and the orientation of an opening at the other end of the air inlet pipe 9 is opposite to the air direction; and one end of the fog spray pipe 10 is disposed in the water fog generator 2, the other end of the fog spray pipe 10 extends into the air channel 6 from the opening, and the orientation of the opening of the fog spray pipe 10 is as the same the air direction.

When the warming stove with a humidifying function works, the fuel in the fuel hopper 12 is burnt to heat up the heat exchanger 3, the fan 7 runs to generate circulating air, some circulating air is fed into the water fog generator 2 from the air inlet pipe 9 and brings the water fog into the air channel 6 from the fog spray pipe 10, the circulating air carries the water fog to flow through the heat exchange region 13, and the water fog is gasified at a high temperature, so that the circulating air is changed to be wet air in the process and is carried into the warming space from an outlet at the tail end of the air channel.

Figure 2:
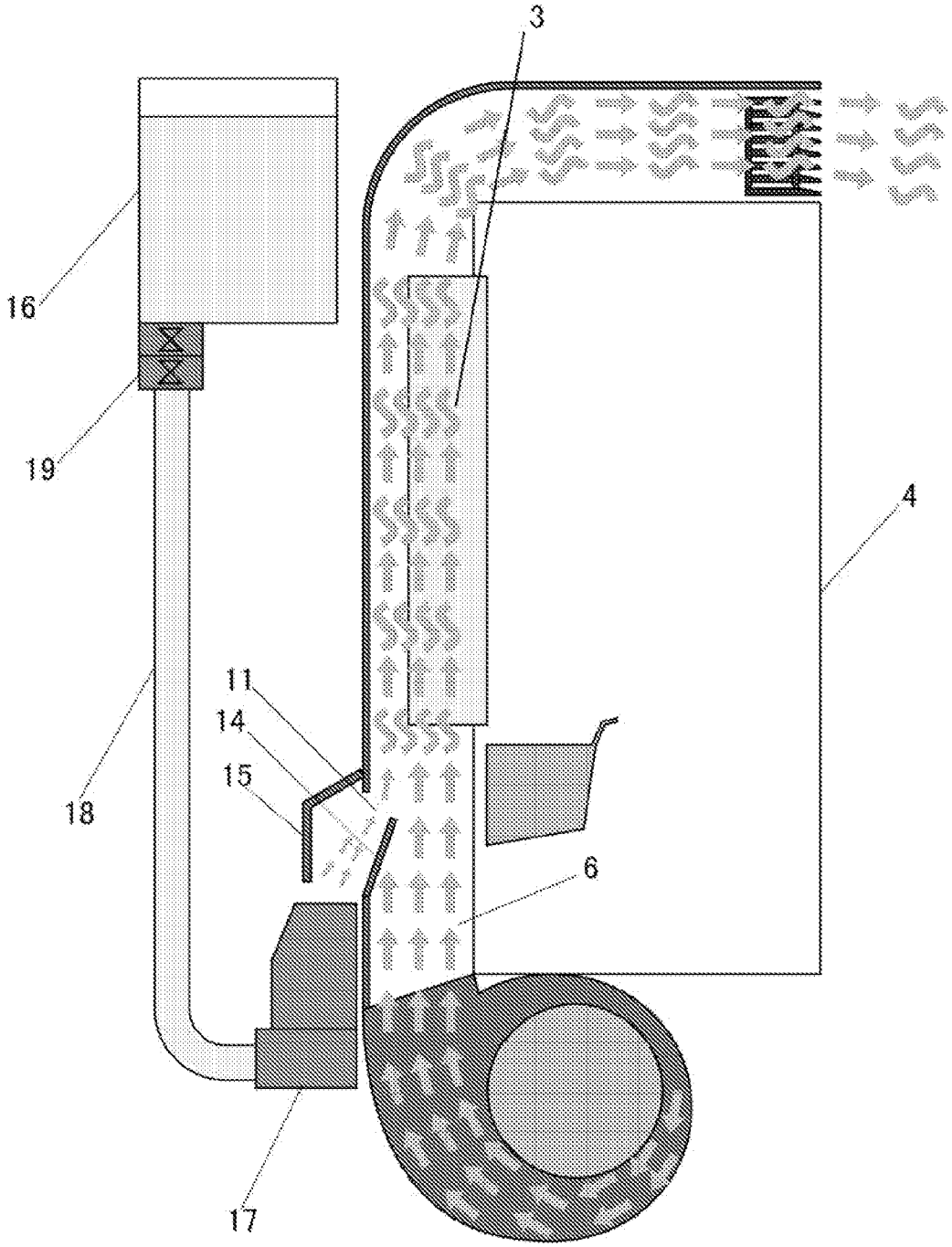
FIG. 2 is a structure diagram showing a warming stove with a humidifying function in an embodiment 2 of the present invention.
Figure 3:
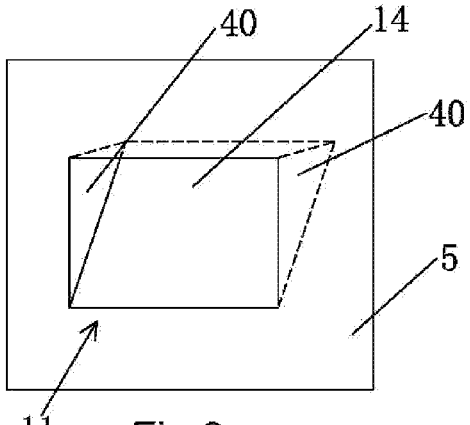
FIG. 3 is a structure diagram showing the installation of a guide plate in the embodiment 2 of the present invention.

Embodiment 2: compared with the warming stove of the embodiment 1, a warming stove with a humidifying function shown in FIG. 2 and FIG. 3 is characterized in that the lower end of the opening 11 is bent towards the direction of the stove cavity to form into a guide plate 14, a gap for air ventilation is remained between the guide plate 14 and the wall of the stove cavity, an angle between the guide plate 14 and the plane of an air resistant clapboard 5 main body is 15-50 degrees, the guide plate 14 is a plane plate, the lower end of the guide plate 14 is connected with the lower end of the opening 11, and the left end and the right end of the guide plate 14 are connected with the air-resistant clapboard 5 by a triangular plate 40 to avoid the air leakage.

As shown in FIG. 2, the water fog generator comprises a water box 16 and a water fog generating cavity 17, which are disposed with each other in a splitting way, wherein the water box 16 is made from a heat conducting material, and the water box 16 is disposed at the place that is adjacent to the heat exchanger 3 outside the air channel 6; and the water fog generating cavity 17 is internally provided with an ultrasonic wave energy converter, the water fog generating cavity 17 is disposed outside the opening 11, an air guide sleeve 15 is disposed outside the opening 11, and a fog spray opening of the water fog generating cavity 17 is disposed in the opening at the lower end of the air guide sleeve 15.

The water box 16 is connected with the water fog generating cavity 17 by a water pipe 18, and the water pipe 18 has a certain water storage capacity due to a height difference between the water box 16 and the water fog generating cavity 17, wherein the saturation capacity of the cubage, i.e. the water level ultrahigh quantity or the spillage of the ultrasonic wave energy converter in the water fog generating cavity when the water box needs to be fed with water, can cause an accident. Therefore, a connecting place between the water pipe 18 and the water box 16 is provided with a two-way valve 19 for simultaneously sealing the water pipe and the water box or communicating the water pipe with the water box.

Figure 4:
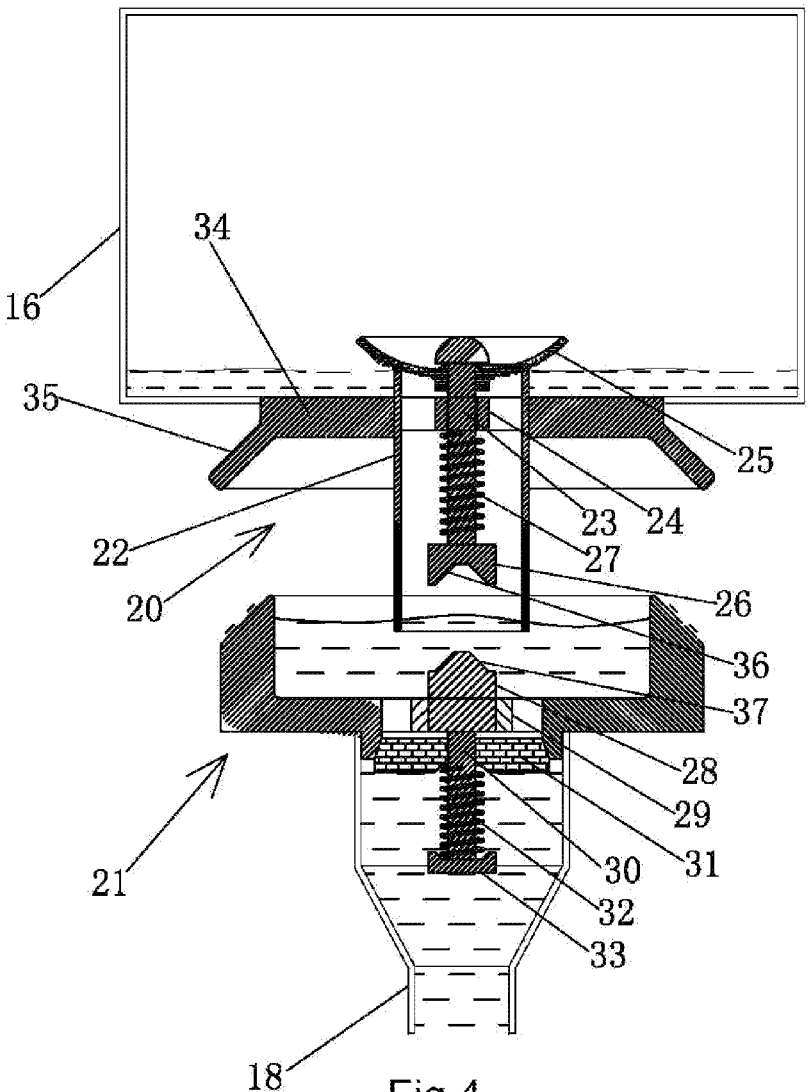
FIG. 4 is a schematic diagram showing a separation status between an upper valve and a lower valve of a two-way valve in the embodiment 2.

As shown in FIG. 4, the two-way valve 19 comprises an upper valve body 20 disposed on the water box 16 and a lower valve body 21 disposed on the water pipe 18, wherein the upper valve body 20 comprises a sleeve 22, the upper end of the sleeve 22 is communicated with the water box 16, the sleeve 22 is internally provided with an ejector rod 23 and an ejector rod positioning ring 24, a plurality of convex ribs are disposed around the ejector rod positioning ring 24, a plurality of gaps for water and air circulation are remained among every two adjoining convex ribs, and the ejector rod positioning ring 24 is connected with the inner wall of the sleeve 22 by the convex ribs.

The ejector rod 23 is movably sleeved in the ejector rod positioning ring 24, the upper end of the ejector rod 23 is provided with a first seal ring 25 for sealing an opening at the upper end of the sleeve, the first seal ring 25 is umbrella-shaped, the lower end of the ejector rod 23 is provided with an ejector block 26, a first spring 27 is sleeved on the ejector rod between the ejector block 26 and the ejector rod positioning ring 24, and two ends of the first spring 27 respectively lean against the ejector block 26 and the ejector rod positioning ring 24.

The lower valve body 21 comprises a colliding block 28 matched with the ejector block 26, the colliding block 28 is fixed on a colliding block positioning ring 29, the colliding block positioning ring 29 is also fixedly connected with the inner wall of the opening at the lower valve body by the convex ribs, the lower end of the colliding block 28 is connected with a valve rod 30, a second seal ring 31 for sealing an opening of the lower valve is movably sleeved on the valve rod 30, a second spring 32 is sleeved on the valve rod 30, the upper end of the second spring 32 leans against the bottom surface of the second seal ring 31, and the lower end of the second spring 32 leans against a spring seat 33 disposed at the lower end of the valve rod 30.

The water box 16 is provided with a water box cover 34 for feeding water, the upper valve body 20 is fixed on the water box cover 34, the water box cover 34 is in threaded connection with the water tank 16, a flange 35 is slantwise and downwards disposed along with the periphery of the water box cover 34, the shape of the upper end of the lower valve body 21 matches with that of the flange 35, and the flange 35 is buckled on the lower valve body 21. In order to be convenient to position, the bottom of the ejector block 26 is provided with a groove 36, and the top of the colliding block 28 is correspondingly provided with a lug boss 37 matched with the ejector block.

As shown in FIG. 4, the seal rings of the upper valve and the lower valve are used for respectively sealing the valve body under the function of each spring when the upper valve body is separated from the lower valve body.

Figure 5:
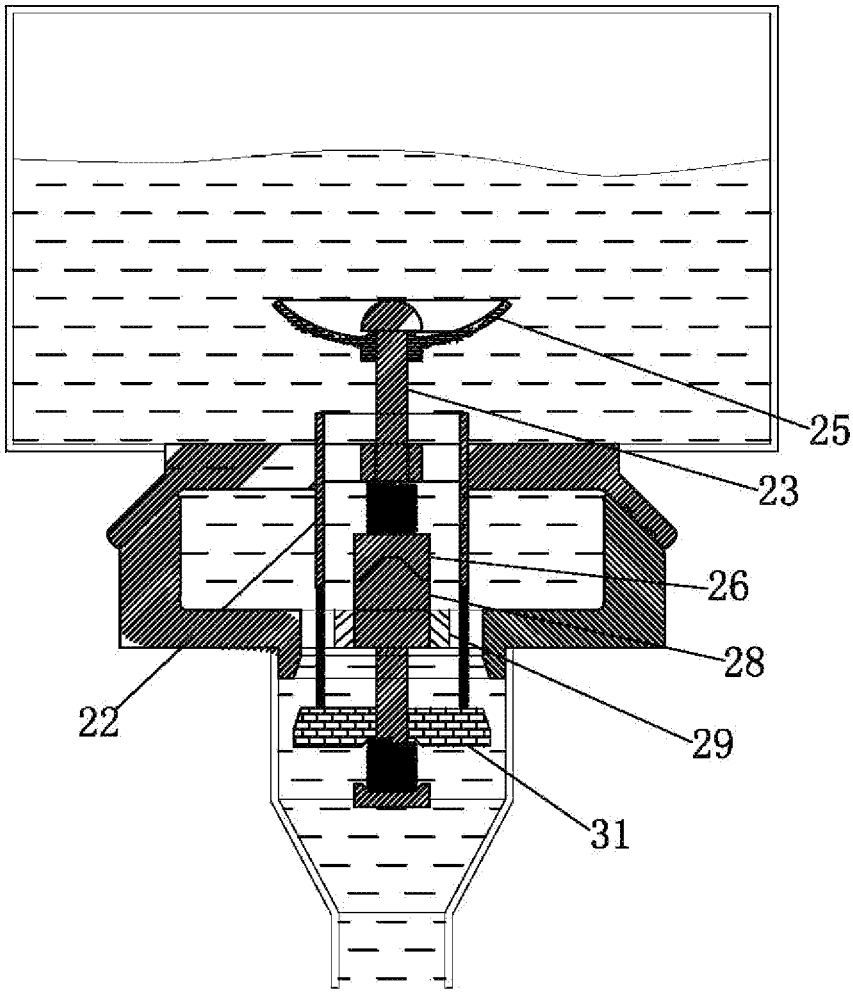
FIG. 5 is a schematic diagram showing a combination status between an upper valve and a lower valve of a two-way valve in the embodiment 2.

The lower end of the sleeve 22 at the upper valve body is provided with a plurality of openings for penetrating through the convex ribs on the colliding block positioning ring 29, as shown in FIG. 5, the lower end of the sleeve 22 of the upper valve body penetrates through the colliding block positioning ring 29 to downwards press a second seal ring 31 to get through the lower valve body, and the ejector rod 23 upwards moves to get through the upper valve body due to the effect between the ejector block 26 of the upper valve body and the colliding block 28 of the lower valve body when the upper valve body is combined with the lower valve body.

Figure 6:
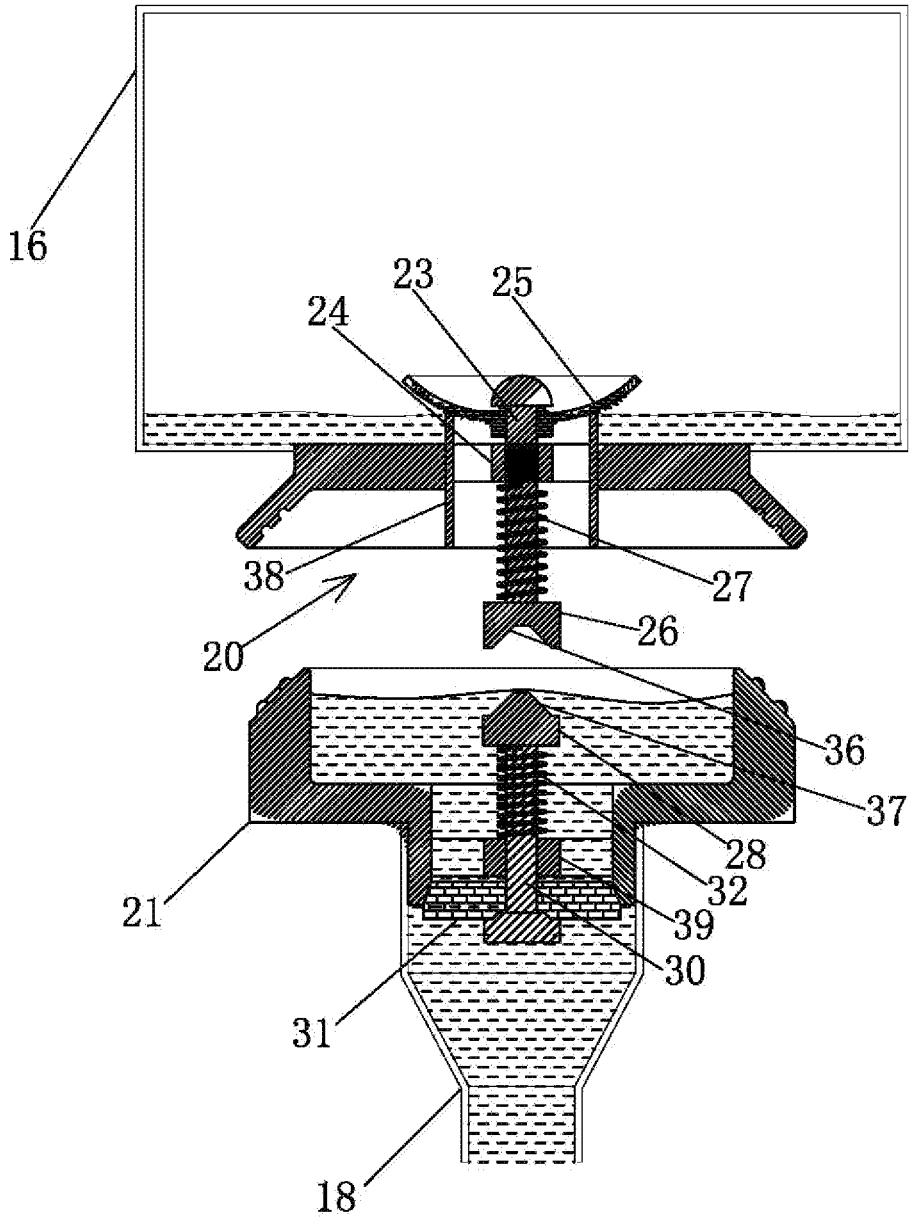
FIG. 6 is a schematic diagram showing a separation status between an upper valve and a lower valve of a two-way valve in an embodiment 3 of the present invention.

Embodiment 3: compared the embodiment 2, as shown in FIG. 6, the two-way valve comprises an upper valve body 20 disposed on the water box 16 and a lower valve body 21 disposed on the water pipe 18, wherein the upper valve body 20 comprises an outer ring 38, the upper end of the outer ring 38 is communicated with the water box 16, the outer ring 38 is internally provided with an ejector rod 23 and an ejector rod positioning ring 24, and the ejector rod positioning ring 24 is fixedly connected with the inner wall of the outer ring; and specifically, a plurality of convex ribs are disposed along with the periphery of the outer ring of the ejector rod positioning ring 24, and a plurality of gaps for water and air circulation are remained among every two adjoining convex ribs, and the ejector rod positioning ring 24 is fixedly connected with the inner wall of the outer ring by the convex ribs.

The ejector rob 23 is movably sleeved in the ejector rod positioning ring 24, the upper end of the ejector rob 23 is provided with a first seal ring 25 for sealing the opening at the upper end of the seal outer ring, the first seal ring 25 is umbrella-shaped, the lower end of the ejector rob 23 is provided with an ejector block 26, a first spring 27 is sleeved on the ejector rod between the ejector 26 and the ejector rod positioning ring 24, and two ends of the first spring 27 respectively lean against the ejector block 26 and the ejector rod positioning ring 24.

The lower valve body 21 comprises a valve rod 30 and a valve rod positioning ring 39, wherein the valve rod 30 is movably sleeved in the valve rod positioning ring 39, the valve rod positioning ring 39 is also connected with the inner wall of the opening of the lower valve body by the convex ribs, the gaps for water and air circulation are remained among every two adjoining convex ribs, the upper end of the valve rod 30 is provided with a colliding block 28 matched with the ejector block 26, a second seal ring 31 for sealing the opening of the lower valve body is fixedly sleeved on the valve rod under the valve rod positioning ring 39, a second spring 32 is sleeved on the valve rod above the valve rod positioning ring 39, and two ends of the second spring 32 respectively lean against the colliding block 28 and the valve rod positioning ring 39.

In order to be convenient to position when the upper valve body is combined with the lower valve body, the bottom of the ejector block 26 is provided with a groove 36, and the top of the colliding block 28 is correspondingly provided with a lug boss 37 matched with the ejector block.

As shown in FIG. 6, the seal rings of the upper valve and the lower valve are used for respectively sealing the valve body under the function of each spring when the upper valve body is separated from the lower valve body.

Figure 7:
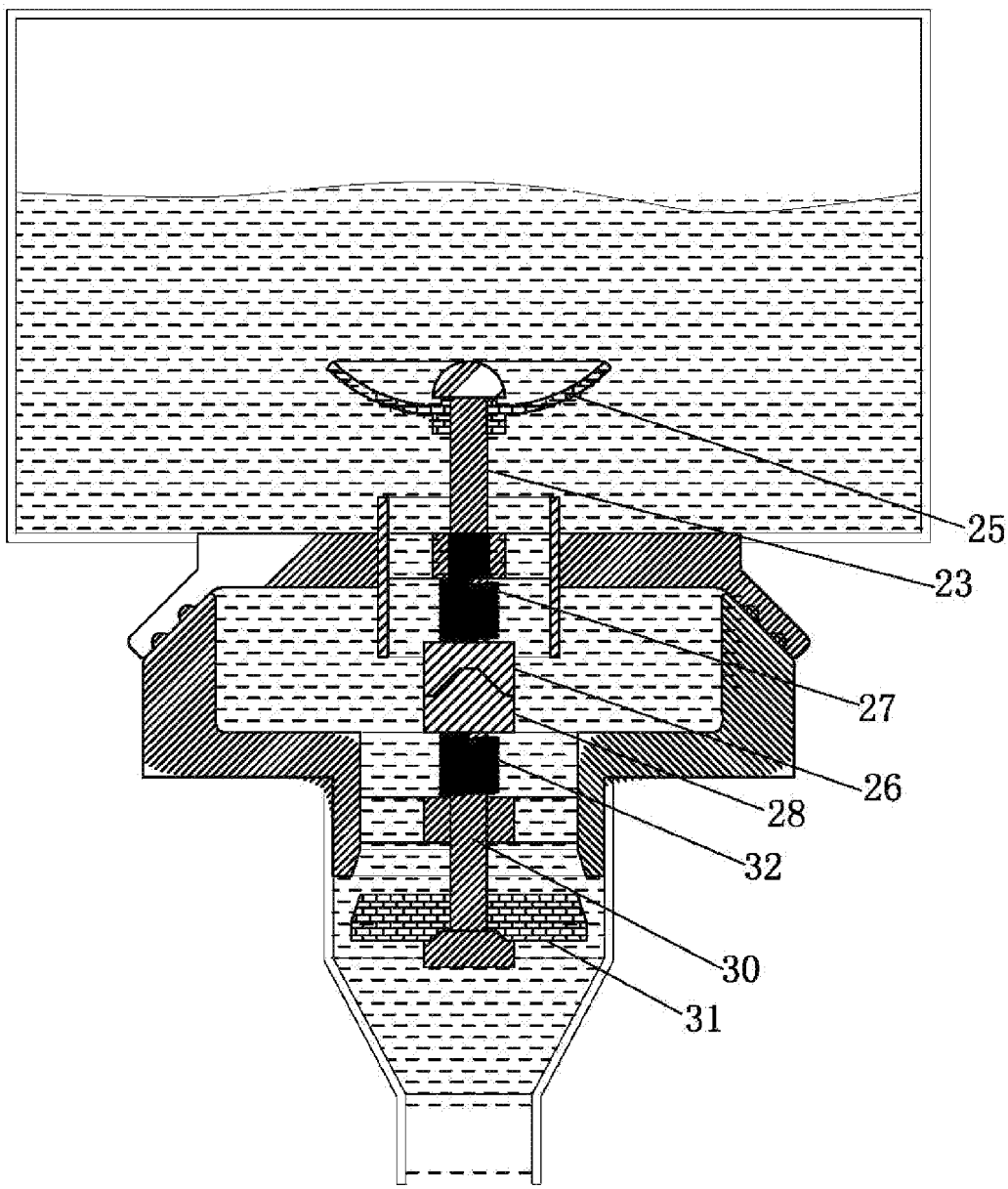
FIG. 7 is a schematic diagram showing a combination status between an upper valve and a lower valve of a two-way valve in the embodiment 3.

As shown in FIG. 7, the ejector block 26 of the upper valve body is collided with the colliding block 28 of the lower valve body, the ejector rod 23 of the upper valve rod drives the first seal ring 25 to upwards move so as to get through the upper valve body, and the valve rod 30 of the lower valve body drives the second seal ring 31 to downwards move so as to get through the lower valve body when the upper valve body is combined with the lower valve body.

What is claimed is:

1. A warming stove with a humidifying function comprising:

a water fog generator and a stove body; wherein the stove body is internally provided with a stove cavity, a heat exchanger is disposed on a wall of the stove cavity, an air-resistant clapboard is disposed behind the stove cavity, an air channel is formed between the air-resistant clapboard and the stove cavity, a region between the air-resistant clapboard and the heat exchanger is a heat exchange region, an initial end of the air channel is connected with a fan, and a tail end of the air channel is an air supply outlet;

an opening is disposed on the air-resistant clapboard adjacent to the initial end of the air channel, a lower end of the opening is bent towards the direction of the stove cavity to form into a guide plate, and a spray jet of the water fog generator is faced and communicated with the opening.

2. The warming stove with a humidifying function according to claim 1, wherein the guide plate is a plane plate, a left end and a right end of the guide plate are connected with the air-resistant clapboard by a triangular plate respectively.

3. The warming stove with a humidifying function according to claim 1, wherein the opening is externally provided with an air guide sleeve, and the spray jet of the water fog generator is disposed in the opening at the lower end of the air guide sleeve.

4. The warming stove with a humidifying function according to claim 1, wherein the water fog generator comprises a water box and a water fog generating cavity, which are disposed with each other in a splitting way, the water box is connected with the water fog generating cavity by a water pipe, and the water fog generating cavity is disposed at the opening of the air-resistant clapboard.

5. The warming stove with a humidifying function according to claim 4, wherein a connecting place between the water pipe and the water box is provided with a two-way valve for simultaneously sealing the water box and the water pipe when the water box is separated from the water pipe or for simultaneously communicating the water box with the water pipe when the water box is connected with the water pipe.

6. The warming stove with a humidifying function according to claim 5, wherein the two-way valve comprises an upper valve body disposed on the water box and a lower valve body disposed on the water pipe, the upper valve body comprises a sleeve for jacking and getting through the lower valve, an upper end of the sleeve is communicated with the water box, the sleeve is internally provided with an ejector rod and an ejector rod positioning ring, the ejector rod positioning ring is fixedly connected with an inner wall of the sleeve, the ejector rod is movably sleeved in the ejector rod positioning ring, the upper end of the ejector rod is provided with a first seal ring for sealing an opening at the upper end of the sleeve, a lower end of the ejector rod is provided with an ejector block, a first spring is sleeved on the ejector rod between an ejector block and the ejector rod positioning ring, and two ends of the first spring respectively lean against the ejector block and the ejector rod positioning ring; the lower valve body comprises a colliding block matched with the ejector block, the colliding block is fixed on a colliding block positioning ring, the colliding block positioning ring is connected with the lower valve body, the lower end of the colliding block is connected with a valve rod, a second seal ring for sealing an opening of the lower valve is movably sleeved on the valve rod, a second spring is sleeved on the valve rod, the upper end of the second spring leans against the second seal ring, and the lower end of the second spring leans against a spring seat at the lower end of the valve rod; and an lower end of the sleeve of the upper valve body penetrates through the colliding block positioning ring to downwards press the second seal ring so as to get through the lower valve body, and the ejector rod upwards move to get through the upper valve body due to the functions of the ejector block of the upper valve body and the colliding block of the lower valve body when the upper valve body and the lower valve body are combined with each other.

7. The warming stove with a humidifying function according to claim 6, wherein the water box is provided with a water box cover for feeding water, the upper valve body is fixed on the water box cover, a flange is slantwise and downwards disposed along with the periphery of the water box cover, the shape of the upper end of the lower valve body matches with that of the flange, and the flange is buckled on the lower valve body.

8. The warming stove with a humidifying function according to claim 6, wherein the bottom of the ejector block is provided with a groove or a lug boss, and the top of the colliding block is correspondingly provided with a lug boss or a groove matched with the ejector block.

9. The warming stove with a humidifying function according to claim 5, wherein the two-way valve comprises an upper valve body disposed on the water box and a lower valve body disposed on the water pipe, the upper valve body comprises an outer ring, the upper end of the outer ring is communicated with the water box, the outer ring is internally provided with an ejector rod and an ejector rod positioning ring, the ejector rod positioning ring is fixedly connected with the inner wall of the outer ring, the ejector rod is movably sleeved in the ejector rod positioning ring, the upper end of the ejector rod is provided with a first seal ring for sealing an opening at the upper end of the outer ring, the lower end of the ejector rod is provided with an ejector block, a first spring is sleeved on the ejector rod between the ejector block and the ejector rod positioning ring, and two ends of the first spring respectively lean against the ejector block and the ejector rod positioning ring; the lower valve body comprises a valve rod and a valve rod positioning ring, wherein the valve rod is movably sleeved in the valve rod positioning ring, the valve rod positioning ring is connected with the inner wall of the opening of the lower valve body, the upper end of the valve rod is provided with a colliding block matched with the ejector block, a second seal ring for sealing the opening of the lower valve body is fixedly sleeved on the valve rod under the valve rod positioning ring, a second spring is sleeved on the valve rod above the valve rod positioning ring, and two ends of the second spring respectively lean against the colliding block and the valve rod positioning ring; and the ejector block of the upper valve body is collided with the colliding block of the lower valve body, the ejector rod and the first seal ring of the upper valve body upwards move to get through the upper valve body, and the valve rod and the second seal ring of the lower valve body downwards move to get through the lower valve body when the upper valve body and the lower valve body are combined with each other.

10. The warming stove with a humidifying function according to claim 9, wherein the water box is provided with a water box cover for feeding water, the upper valve body is fixed on the water box cover, a flange is slantwise and downwards disposed along with the periphery of the water box cover, the shape of the upper end of the lower valve body matches with that of the flange, and the flange is buckled on the lower valve body.

11. The warming stove with a humidifying function according to claim 9, wherein the bottom of the ejector block is provided with a groove or a lug boss, and the top of the colliding block is correspondingly provided with a lug boss or a groove matched with the ejector block.

12. The warming stove with a humidifying function according to claim 4, wherein the water box is made from a heat conducting material and is disposed at the place that is adjacent to the heat exchanger outside the air channel.

* * * * *